US006435155B2

(12) United States Patent
Kawamoto

(10) Patent No.: US 6,435,155 B2
(45) Date of Patent: Aug. 20, 2002

(54) OIL FILTER MOUNTING ARRANGEMENT FOR A MOTORCYCLE ENGINE

(75) Inventor: Hitoshi Kawamoto, Hamamatsu (JP)

(73) Assignee: Suzuki Motor Corporation, Shizuoka-Ken (JP)

( * ) Notice: Subject to any disclaimer, the term of this patent is extended or adjusted under 35 U.S.C. 154(b) by 0 days.

(21) Appl. No.: 09/753,729

(22) Filed: Jan. 3, 2001

(30) Foreign Application Priority Data

Feb. 21, 2000 (JP) ..... 2000-043009

(51) Int. Cl.[7] ..... F01M 11/03
(52) U.S. Cl. ..... 123/196 A
(58) Field of Search ..... 123/196 A, 196 R

(56) References Cited

U.S. PATENT DOCUMENTS 5,199,395 A * 4/1993 Mizumura et al. ..... 123/196 A
5,439,585 A * 8/1995 Arakawa ..... 123/196 A
5,857,442 A * 1/1999 Sumi ..... 123/196 A

FOREIGN PATENT DOCUMENTS

JP 07-011955 1/1995
JP 10-238327 9/1998

* cited by examiner

*Primary Examiner*—Paul J. Hirsch
(74) *Attorney, Agent, or Firm*—Darby & Darby

(57) ABSTRACT

An overall cylindrical oil filter and oil cooler are arranged widthwise of the vehicle on the left and right and projected forwards, at the lower front part of the engine case of the engine. The oil filter is disposed offset to the right side of the vehicle's width or to the side opposite to the kickstand with respect to the vehicle's center line while the spacing between the exhaust pipes for #2 and #3 cylinders are arranged vertically below the oil filter when the bike is held with the kickstand set down to the ground.

9 Claims, 7 Drawing Sheets

OIL FILTER MOUNTING ARRANGEMENT FOR A MOTORCYCLE ENGINE

BACKGROUND OF THE INVENTION (1) Field of the Invention

The present invention relates to an oil filter mounting arrangement for a four-cycle, inline multi-cylinder motorcycle engine.

(2) Description of the Prior Art

In many motorcycles having a four-cycle multi-cylinder engine mounted thereon, an inline multi-cylinder engine unit having its multiple cylinders inclined forwards with its crankshaft extending widthwise of the bodywork is arranged and suspended in the lower front part of the motorcycle bodywork. In the exhaust system of such an engine, exhaust pipes connected to exhaust ports on the upper front side of the forward tilting cylinders extend from the front part of the engine unit downwards and further are bent around the bottom of the engine unit and directed to the rear so that they are connected together or individually to the muffler arranged in the rear part of the motorcycle body.

In a motorcycle of the above type, in order to minimize bulges to the left and right of the body, the oil filter of the engine unit is attached to the front part of the engine case. In particular, this oil filter arrangement is especially necessary for a motorcycle with its bodywork totally covered by a fairing.

Since the exhaust pipes are laid out in front of and under the oil filter, there occurs an inconvenience of the engine oil dripping and running over the exhaust pipes when the filter is replaced if no countermeasure is taken.

As a prior art oil filter layout configuration of an engine unit of this type, Japanese Patent Application Laid-Open Hei 10 No. 238327 is disclosed. With reference to FIG. 1 showing this prior art, of exhaust pipes 113 extending from the engine (power unit 140), two exhaust pipes 113 in the center are laid out to the left and right sides avoiding the center of the engine, viewed from the front to form a spacing between the exhaust pipes 113, where an oil filter 152 is attached to the engine case. That is, it is considered that the two exhaust pipes 113 in the center are arranged apart in order to avoid oil dropping since the inconvenience of oil dripping from oil filter 152 is attributed to the fact that exhaust pipes 113 are located below oil filter 152. In this figure, 146, 148 and 155 designate a head cover, AC generator and breather chamber, respectively.

The arrangement where the oil filter is arranged in the engine center while the exhaust pipes are laid out avoiding the space under the oil filter viewed from the front, however, makes the exhaust pipes spread and bulge to the left and right sides. As a result, the motorcycle is possible to touch the road surface even at a small bank angle when the bike is banked. Thus, this arrangement constrains and impedes tilting of the bike at a large bank angle.

Particularly for sport motorcycles, active riding performance is important, so that inability to assume a large bank angle means a low turning performance, a serious drawback.

There are cases where an oil cooler is provided along with the oil filter in order to improve the engine cooling performance. In such a case, if the oil filter and oil cooler are laid one over another with respect to the motorcycle's front to rear direction, as disclosed in Japanese Patent Application Laid-Open Hei 7 No. 11955, these will not impede the exhaust pipes. However, if the capacity of the oil cooler is attempted to be increased, the oil cooler becomes large in diameter, hence unavoidably needing a large space between the exhaust pipes, again raising the bank angle concern. Alternatively, if the oil cooler is made too large with respect to the vehicle's front to rear direction in order to secure its capacity, there is a possibility that the oil filter might interfere with the exhaust pipes upon replacement of the filter.

SUMMARY OF THE INVENTION

The present invention has been devised in view of the above drawbacks, and it is therefore an object of the present invention to provide an oil filter mounting arrangement for a four-cycle motorcycle engine, which prevents oil dripping from the oil filter from staining the exhaust pipes upon replacement of the oil filter and permits riding at a large bank angle while providing an oil cooler of a large capacity.

In order to achieve the above object, the present invention is configured as follows:

In accordance with the first aspect of the present invention, an oil filter mounting arrangement for a four-cycle engine for use in a motorcycle wherein the inline multi-cylinder engine comprises: a crankshaft laid out widthwise of the bodywork and mounted in the front lower part of the bodywork; a multiple number of exhaust pipes extended from the front upper part of the engine to the lower part of the engine and bent toward the rear; an oil pan having both side surfaces inclined; and a multiple number of exhaust pipes extended to the rear while being split to the left and right along the inclined side surfaces, forming a spacing between the exhaust pipes, is characterized in that an oil filter and oil cooler is projectively arranged forwards, side by side, in the lower front part of the engine; the oil filter is disposed on the side opposite to the kickstand with respect to the vehicle's center line; and the spacing between the exhaust pipes is positioned vertically below the oil filter in the state where the kickstand is set grounded.

In accordance with the second aspect of the present invention, the oil filter mounting arrangement for a four-cycle engine for use in a motorcycle, having the above first feature is characterized in that when the kickstand is retracted in the unused state, one of the exhaust pipes is arranged vertically below the oil filter.

In accordance with the third aspect of the present invention, the oil filter mounting arrangement for a four-cycle engine for use in a motorcycle, having the above first feature is characterized in that the exhaust pipes are gathered below the engine while the oil filter is disposed in front of the gathering of the exhaust pipes.

In accordance with the fourth aspect of the present invention, the oil filter mounting arrangement for a four-cycle engine for use in a motorcycle, having the above second feature is characterized in that the exhaust pipes are gathered below the engine while the oil filter is disposed in front of the gathering of the exhaust pipes.

In accordance with the fifth aspect of the present invention, the oil filter mounting arrangement for a four-cycle engine for use in a motorcycle, having the above first feature is characterized in that the motorcycle bodywork including the engine sides is covered by a fairing.

In accordance with the sixth aspect of the present invention, the oil filter mounting arrangement for a four-cycle engine for use in a motorcycle, having the above second feature is characterized in that the motorcycle bodywork including the engine sides is covered by a fairing.

In accordance with the seventh aspect of the present invention, the oil filter mounting arrangement for a four-cycle engine for use in a motorcycle, having the above third feature is characterized in that the motorcycle bodywork including the engine sides is covered by a fairing.

In accordance with the eighth aspect of the present invention, the oil filter mounting arrangement for a four-cycle engine for use in a motorcycle, having the above fourth feature is characterized in that the motorcycle bodywork including the engine sides is covered by a fairing.

In accordance with the ninth aspect of the present invention, the oil filter mounting arrangement for a four-cycle engine for use in a motorcycle, having any of the above first through eighth features is characterized in that the oil cooler is disposed on the same side as the water pump is, with respect to the front to rear direction of the motorcycle.

According to the present invention, since the oil filter and oil cooler are arranged side by side and projected forwards, at the lower front part of the engine, it is possible to enlarge the oil filter and oil cooler in their radius direction and hence enlarge their capacities without having to take care of obstacles. Further, since the oil filter is arranged offset on the side opposite to the kickstand with respect to the vehicle's center line while the spacing between the exhaust pipes are formed vertically below the oil filter when the kickstand is set down, the oil dropping during replacement of the oil filter will not stain the exhaust pipes.

In the present invention, one of the preferable features is that one of the exhaust pipes is arranged vertically below the oil filter when the kickstand is retracted in its unused position. With this arrangement, when the kickstand is set down(in the parking state), the spacing between the exhaust pipes can be positioned vertically below the oil filter. Since the spacing between the exhaust pipes is not located vertically below the oil filter when the motorcycle is set upright where the oil filter is not usually replaced, it is possible to inhibit the spread of the exhaust pipes to the left and right sides as low as possible. As a result, it is possible to assume a large bank angle. Since the oil filter and oil cooler are arranged side by side in the present invention, the position of the oil filter is offset from the center of the vehicle. If, in such a motorcycle, the spacing between the exhaust pipes is positioned vertically below the oil filter with the motorcycle positioned upright, the exhaust pipes will further spread to the left and right.

Another preferable feature of the present invention is that the exhaust pipes are gathered under the engine while the oil filter is disposed in front of the gathering of the exhaust pipes. Since there is a difference in exhaust pipe temperature across the gathering and the temperature of the exhaust pipes after the gathering is higher than that before that, placement of the oil cooler at a site open to the atmosphere located before the gathering where the exhaust pipes are lower in temperature, makes it possible to improve the performance of cooling the oil. Further, as to the oil filter, this configuration similarly makes the oil unlikely to be affected by heat from the exhaust pipes, producing a preferable result.

Still another preferable feature of the present invention is that the bodywork of the motorcycle including the engine sides is covered by the faring. Since, in such a motorcycle with a fairing, the left and right sides of the engine are enclosed by the fairing, the oil filter and oil cooler need to be arranged in front of the engine. Therefore, this configuration of the invention is particularly effective. Further, the oil cooler is arranged on the mounted side of the water pump on the engine with respect to the front to rear direction of the vehicle, the distance between the oil cooler and water pump can be reduced thus making it possible to minimize the length of the water hose. Accordingly, it is possible to prevent the cooling water from being warmed by heat from the engine and hence improve the cooling efficiency.

DESCRIPTION OF THE PREFERRED EMBODIMENTS

The embodiment of the present invention will hereinafter be described in detail with reference to the accompanying drawings.

Figure 1:
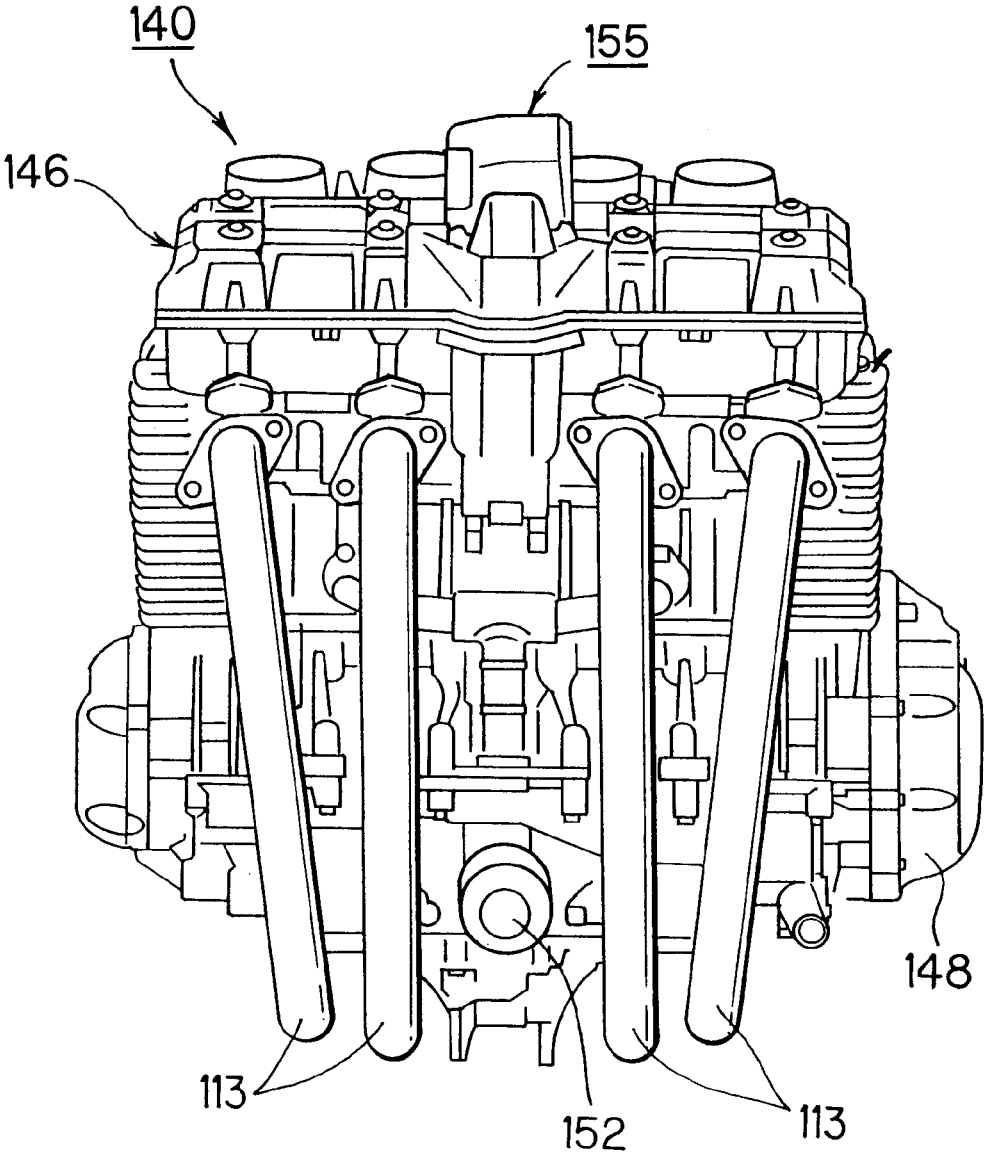
FIG. 1 PRIOR ART
FIG. 1 is a front view showing a layout configuration of an oil filter in a conventional engine unit.
Figure 2:
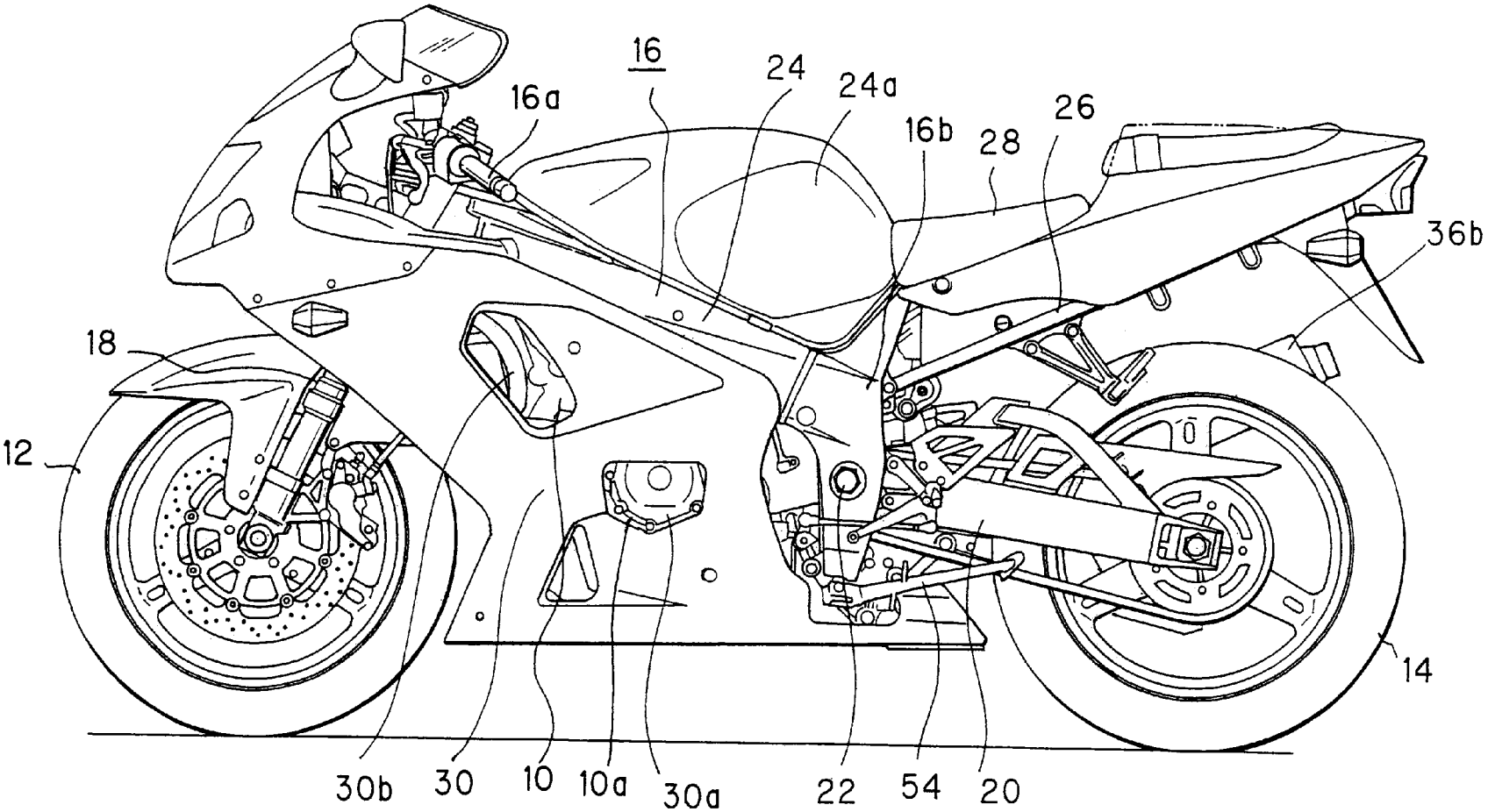
FIG. 2 is a side view of a motorcycle as an example of the embodiment of the present invention.
Figure 3:
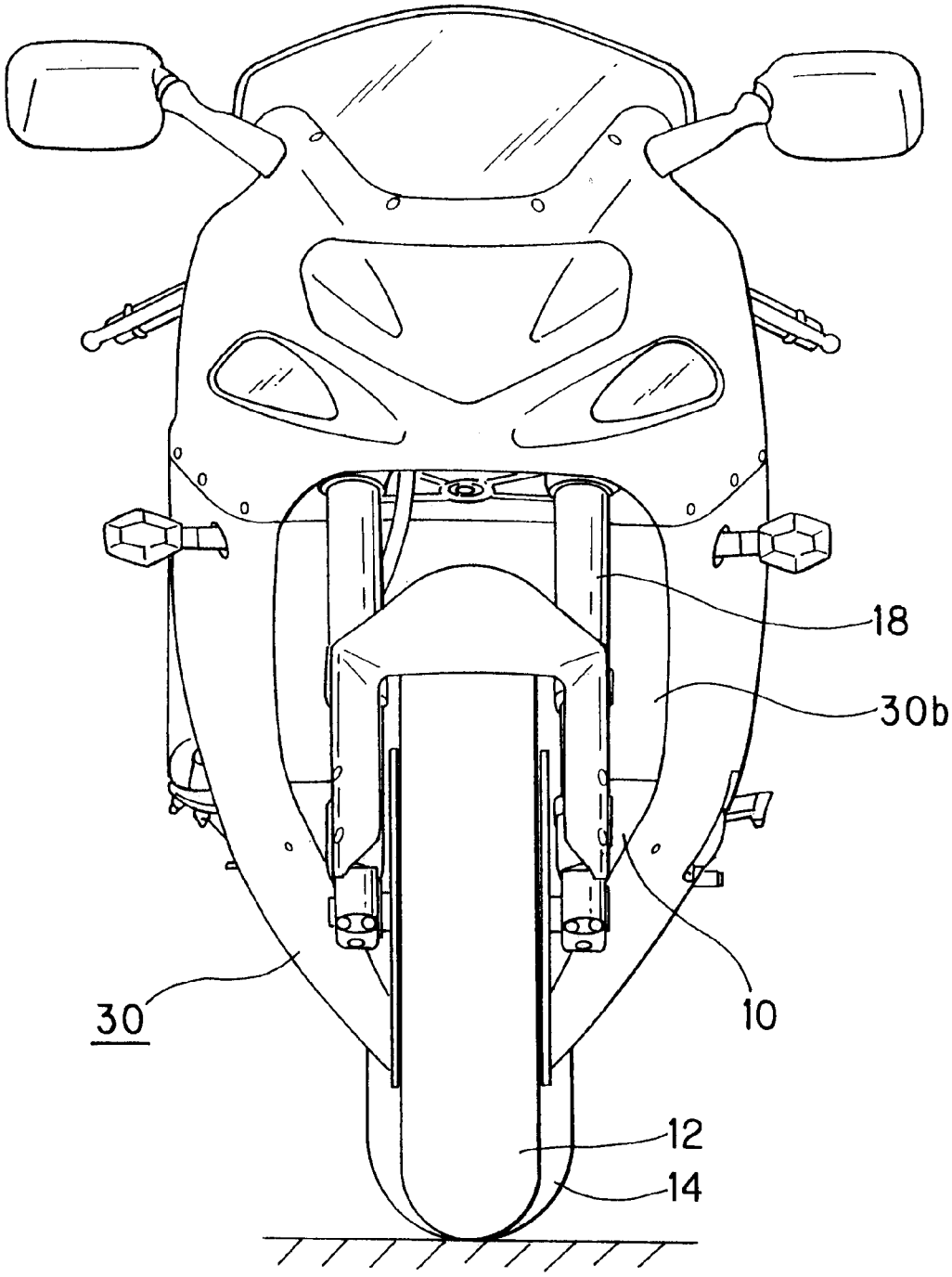
FIG. 3 is a front view showing the motorcycle.
Figure 4:
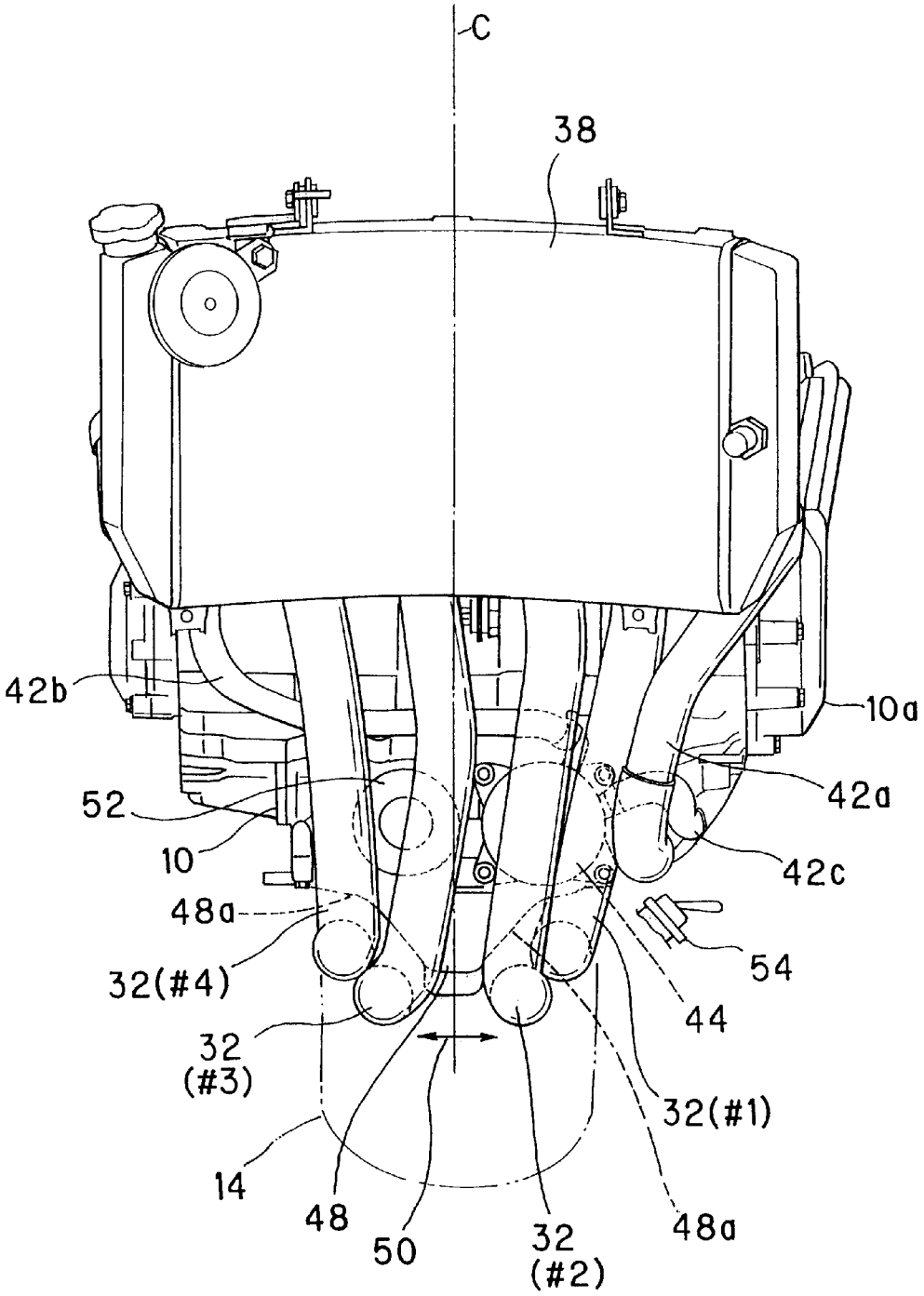
FIG. 4 is a front view showing the detail of the engine.
Figure 5:
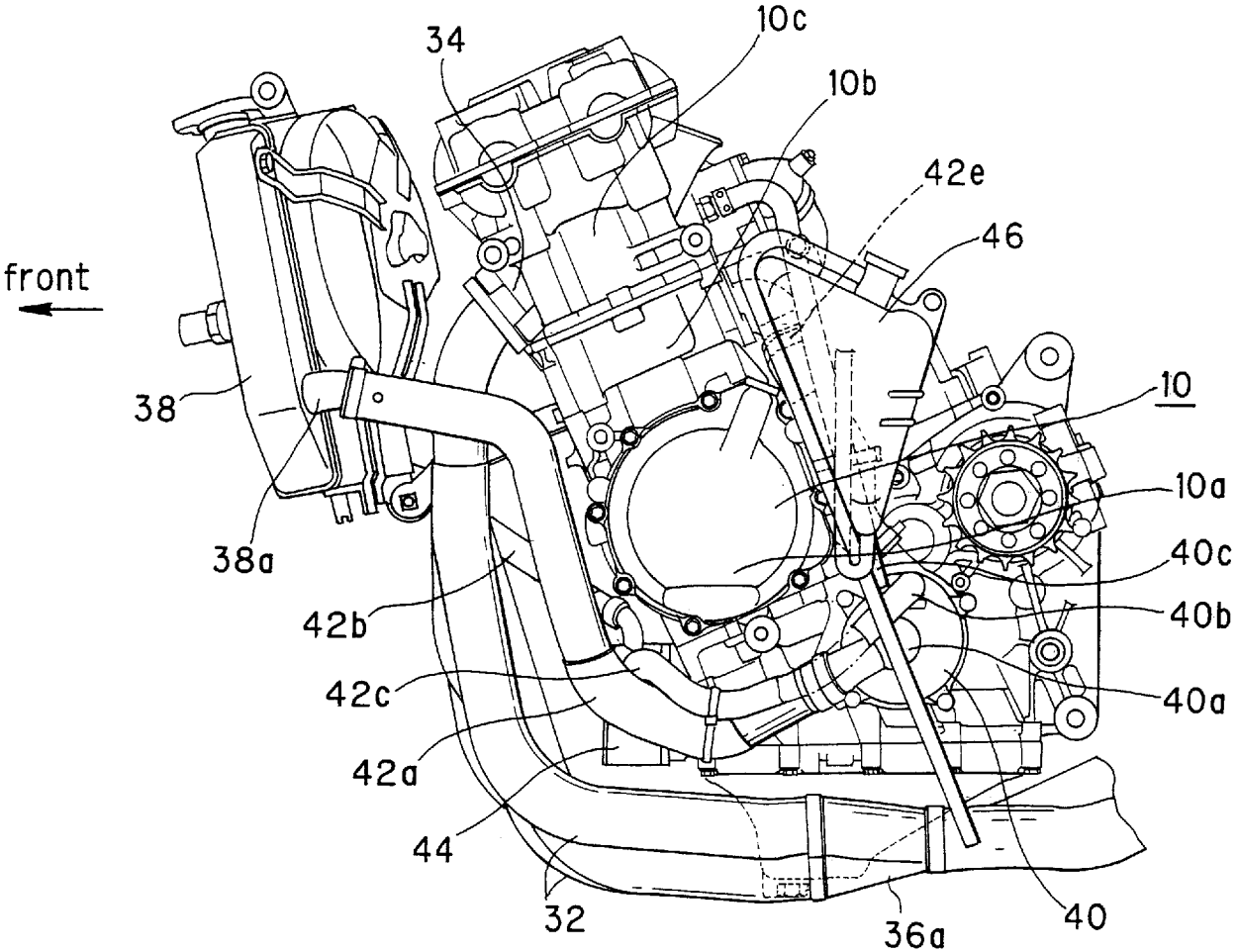
FIG. 5 is a left side view showing the engine.
Figure 6:
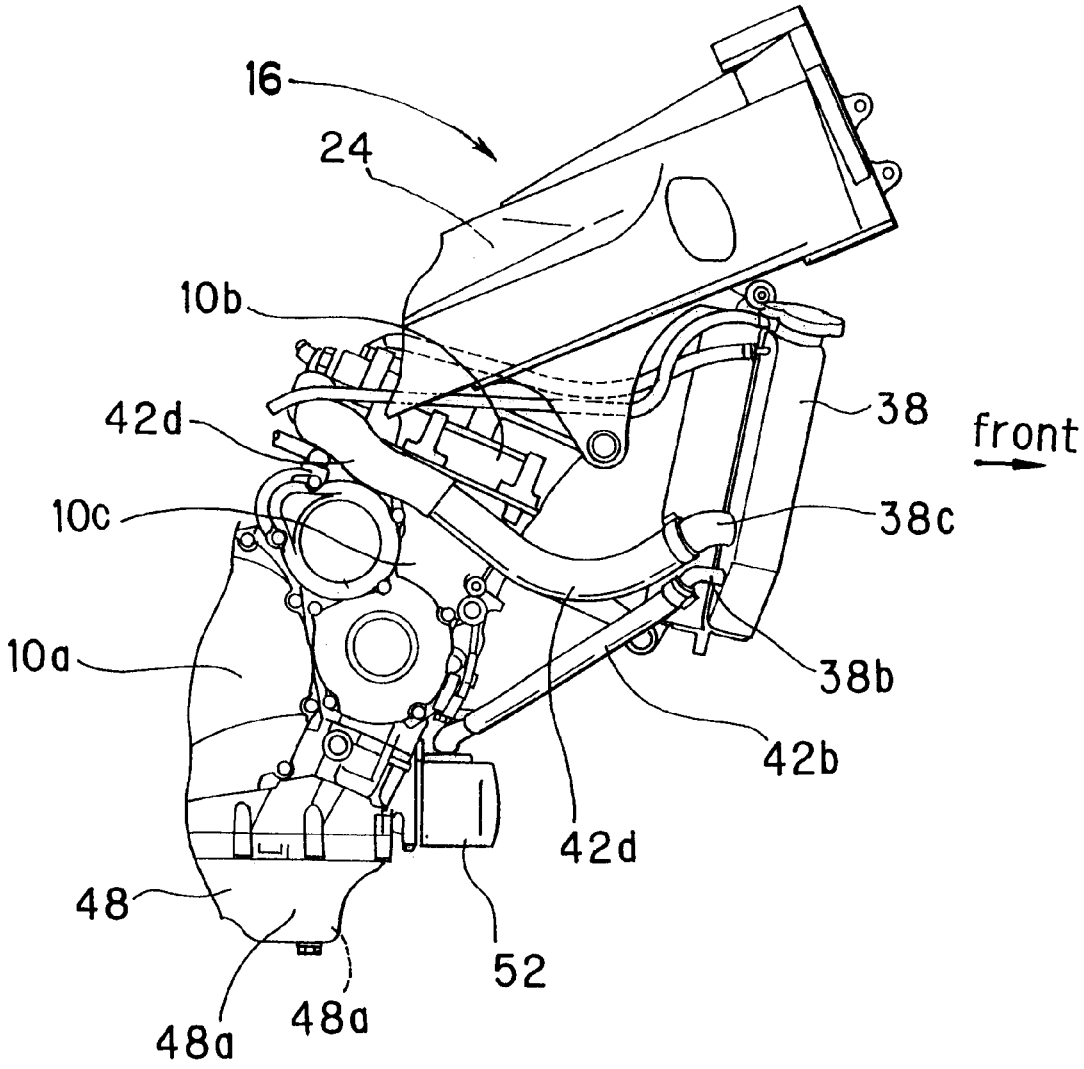
FIG. 6 is a right side view showing essential parts of the engine.
Figure 7:
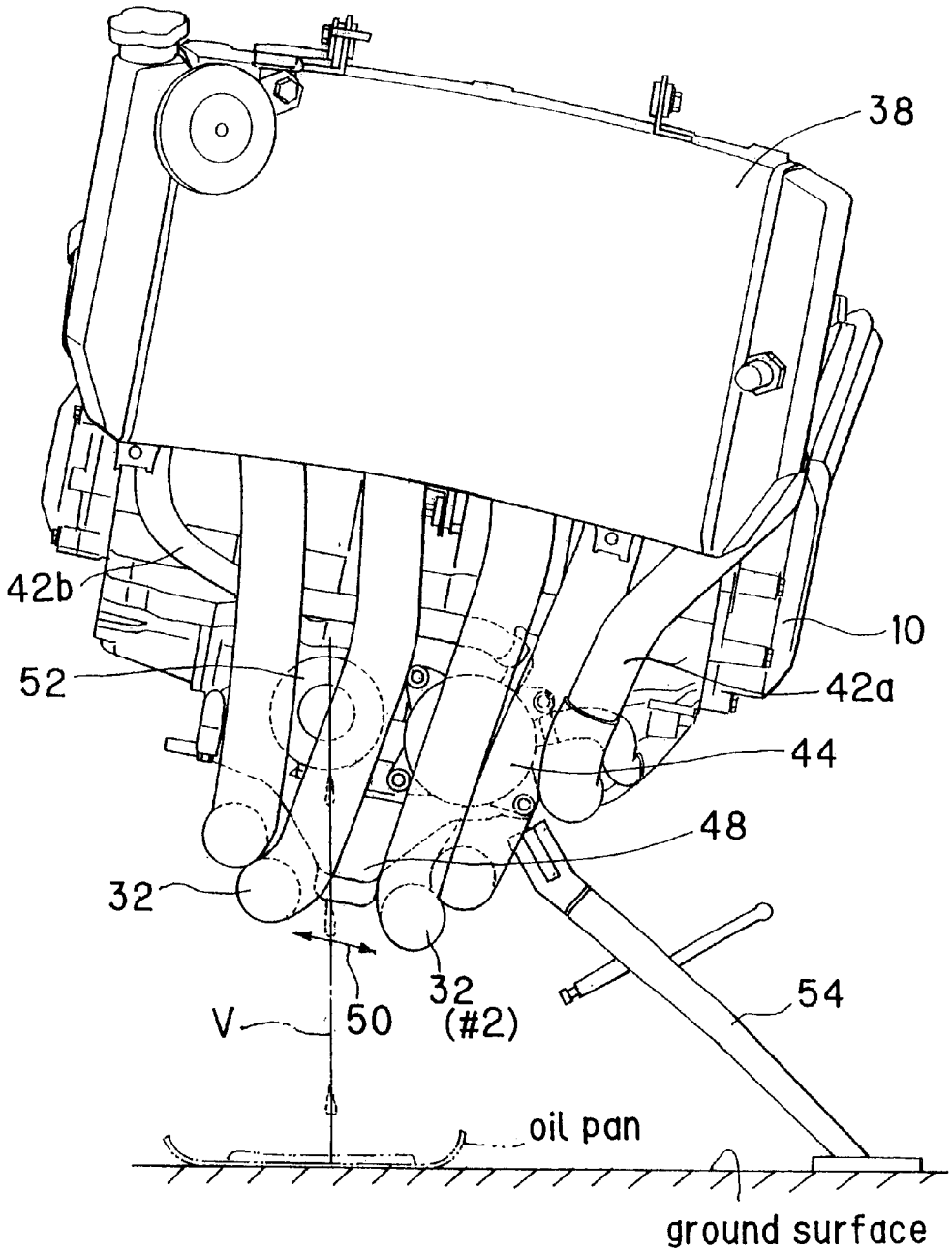
FIG. 7 is a view for illustrating the state upon replacement of an oil filter with the kickstand down.

FIGS. 2 through 7 show an embodiment of the present invention, FIG. 2 is a side view of a motorcycle, FIG. 3 is a front view of the same, FIG. 4 is a front view showing the detail of the engine unit, FIG. 5 is a left side view showing the engine unit, FIG. 6 is a right side view showing essential parts of the engine unit and FIG. 7 is a view for illustrating the state upon replacement of the oil filter with the kickstand down.

As shown in FIGS. 2 and 3, the motorcycle of this embodiment has an inline multi-cylinder engine 10 with its crankshaft arranged widthwise of the motorcycle body and mounted in the front lower part of the bodywork between front and rear wheels, designated at 12 and 14, respectively, Engine 10 is suspended by a frame 16. Arranged at the front end of frame 16 is a head pipe 16*a* for rotatably supporting steering forks 18 (for bearing front wheel 12) while a main tube 16*b* having a pivot shaft 22 (for axially supporting a rear swing arm 20 for supporting the rear wheel) formed therewith is arranged at the rear end. Frame 16 is configured of a twin tube type and a pair of tank tubes 24 of aluminum rectangular pipe having a rectangular section are extended from steering head pipe 16*a* in the lower and rear direction. A fuel tank 24*a* is mounted on and fixed to these tank tubes 24. Seat rails 26 are extended from the upper rear side of main tube 16*b* in the upper and rear direction and a seat 28 is placed thereon.

A fairing 30 covering the motorcycle covers the bodywork from the front steering above front wheel 12 up to the rear at main tube 16*b*, enclosing engine 10 which is suspended by frame 16, having an overall bullet configuration so as to reduce air resistance while travelling. In order to shape fairing 30 as close to the bodywork as possible, a through-opening 30*a* to expose the magneto cover of an engine case 10*a* is formed. Further, vent windows 30*b* are formed on the front and side faces in order to provide ventilation. A kickstand (prop stand) 54 is pivotally attached at the left-side lower end of main tube 16*b* and supported with a spring so that the stand can be kept at the supporting and retracted positions.

As shown in FIGS. 4 to 6, engine 10 has four cylinders (#1 to #4) each having an exhaust port 34 on the front top thereof, which is coupled to an exhaust pipe 32. Each exhaust pipe 32 extends downwards from the front part of engine 10 towards the rear, being overall L-shaped along the engine's front lower part. Exhaust pipes 32 are gathered below the engine at the gathering 36*a*, which is coupled to a muffler 36*b* disposed in the rear body.

As a cooling system of engine 10, a radiator 38 is disposed in front of engine 10 while a water pump 40 is arranged at a rear lower site of engine 10. The intake port, designated at 40*a*, of water pump 40 is connected to an outlet 38*a* of radiator 38, by an intake water hose 42*a* laid out on the lower left side of the engine. One of the inlet ports to radiator 38, designated at 38*b*, is coupled to an aftermentioned water-cooled type oil cooler 44 by way of a water hose 42*b*. A water hose 42*c* is disposed to provide communication from this oil cooler 44 to the outlet port 40*b* of water pump 40. The other inlet port 38*c* to radiator 38 is coupled to the cylinder head 10*b* of engine 10 by way of a water hose 42*d*. A water hose 42*e* is disposed to provide communication from the cylinder block 10*c* to an ejection port 40*c* of water pump 40. A reservoir tank 46 for storing cooling water is arranged above water pump 40.

Provided for engine case 10*a* at the bottom of engine 10 is an oil pan 48 projected downwards with its side faces (48*a*, 48*a*) inclined forming a downward ridge from the front view. Four exhaust pipes 32—32 from cylinders #1 to #4 are split, two at each side and extended along the respective inclined side faces 48*a*, 48*a* to the rear so as to create a spacing 50 between the two centered exhaust pipes 32 and 32 for cylinders #2 and #3.

An oil filter 52 and oil cooler 44, both being substantially cylindrical are arranged widthwise of the vehicle, on the left and right, being projected forwards, in the lower front of engine case 10*a* of engine 10. Oil filter 52 is a container having a filter element in an external case with an oil passage (not shown) connected to the engine case 10*a* side. In this configuration, oil filter 52 is arranged offset as shown in FIG. 4, to the side (the right side) opposite to kickstand 54 with respect to the vehicle's center line C and the spacing 50 between exhaust pipes 32 and 32 for #2 and #3 cylinders is adapted to be located vertically below (shown with a line V in FIG. 7) oil filter 52 when the motorcycle stands with kickstand 54 set grounded.

According to the motorcycle of this embodiment, since oil filter 52 and oil cooler 44 are arranged side by side and projected forwards in the front lower part of engine 10, the capacities of oil filters 52 and oil cooler 44 can be enlarged in the front to rear direction without the necessity of having to take care of obstacles.

In this case, taking into account the work performance of replacing oil filter 52, it is normal to dispose the oil filter at the side of oil cooler 44 in front of engine case 10*a* as stated above, placing it at other positions makes the replacement difficult and unfeasible. Further, water cooled type oil cooler 44 is also preferred to be as large in capacity as possible in order to improve its cooling performance. Taking this fact into account, the above positioning of the attachment is desirable in view of attachment space. That is, oil filter 52 and oil cooler 44 should be arranged side by side. Therefore, oil filter 52 cannot be mounted at the center of engine 10 as in the prior art (the above-mentioned Japanese Patent Application Laid-Open Hei 10 No. 238327). In contrast, in this embodiment, the spacing between the exhaust pipes is not positioned below the oil filter. That is, oil filter 52 is arranged offset to the side opposite to kickstand 54 with respect to vehicle's center line C as shown in FIG. 4. Spacing 50 between exhaust pipes 32 and 32 for cylinders #2 and #3 is positioned vertically below oil filter as shown in FIG. 7 when kickstand 54 is set grounded. Therefore, with this motorcycle set in the parking position in which the oil element of oil filter 52 is replaced, oil dripping from the attached portion of oil filter 52 flows down through the spacing, so that it is possible to prevent the oil from staining exhaust pipes 32 and 32.

With kickstand 54 retracted or unused as shown in FIG. 4, one of the exhaust pipes 32 is disposed vertically below oil filter 52. By this arrangement, spacing 50 between exhaust pipes 32 and 32 can be positioned vertically below oil filter 52. Since spacing 50 between exhaust pipes 32 and 32 is not located vertically below oil filter 52 when the motorcycle is set upright at which oil filter 52 is not usually replaced, exhaust pipes 32, 32 can be gathered at around the engine bottom, and it is possible to inhibit the spread of exhaust pipes 32, 32 to the left and right sides as low as possible. As a result, it is possible for the motorcycle to assume a large bank angle and hence prevent hindering of riding performance.

Exhaust pipes 32—32 are gathered under engine 10 while oil filter 52 is arranged in front of gathering 36*a* of the exhaust pipes. Since there is a difference in exhaust pipe temperature across gathering 36*a* and the temperature of the exhaust pipes after gathering 36*a* is higher than that before gathering 36*a*, placement of oil cooler 44 at a site open to the atmosphere located before gathering 36*a* where exhaust pipes 32—32 are lower in temperature, makes it possible to improve the performance of cooling the oil. Further, as to oil filter 52, this configuration similarly makes the oil unlikely to be affected by heat from the exhaust pipes, producing a preferable result. Since oil cooler 44 is of a water cooled type, attached to the lower front part of the engine and located behind exhaust pipes 32, 32, water hose 42*c* coupled to oil cooler 44 may be heated. To avoid this, oil cooler 44 is arranged on the mounted side of water pump 40 on the engine (on the left side with respect to the front to rear direction of the vehicle in this embodiment: on the opposite side of the oil filter) as shown in FIGS. 4 to 6, thus minimizing the length of water hose 42*c*, which leads the cooling water injected from water pump 40 to oil cooler 44, whereby the temperature of the cooling water to oil cooler 44 can be kept low. Further, as seen in FIG. 4, at least two fixing bolts of the oil cooler are disposed at positions where they are not hidden by the exhaust pipes.

The bodywork of the motorcycle including the engine 10 sides is covered by fairing 30. Since the left and right sides of the engine are enclosed by the fairing, oil filter 52 and oil cooler 44 need to be arranged at the front of engine 10. Therefore, this configuration of the invention is particularly effective.

It should be noted that oil filter mounting arrangement for a four-cycle engine of the present invention is not limited to the above embodiment.

As has been described, the oil filter mounting arrangement for a four-cycle engine of the present invention enables the motorcycle to be tilted at a large bank angle whilst not allowing dripping oil to stain the exhaust pipes upon replacement of the oil filter, as well as contributing to enlargement of the capacity of the oil cooler.

What is claimed is:

1. An oil filter mounting arrangement for a four-cycle engine for use in a motorcycle, wherein an inline multi-cylinder engine comprises:

a crankshaft laid out widthwise of a bodywork of the motorcycle and mounted in the front lower part of the bodywork;

a multiple number of exhaust pipes extended from the front upper part of the engine to the lower part of the engine and bent toward the rear;

an oil pan having both side surfaces inclined; and wherein, the multiple number of exhaust pipes extended to the rear while being split to the left and right along the inclined side surfaces of the oil pan, thereby forming a spacing between the split exhaust pipes, an oil filter and oil cooler are projectively arranged forwards, side by side, in the lower front part of the engine; the oil filter is disposed on the motorcycle on a side opposite from a side where a kickstand is connected to the motorcycle with respect to the motorcycle's center line; and the spacing between the split exhaust pipes is positioned vertically below the oil filter when the kickstand is in the grounded position.

2. The oil filter mounting arrangement for a four-cycle engine for use in a motorcycle according to claim 1, wherein when the kickstand is retracted in the unused state, one of the exhaust pipes is arranged vertically below the oil filter.

3. The oil filter mounting arrangement for a four-cycle engine for use in a motorcycle according to claim 1, wherein the exhaust pipes are gathered below the engine while the oil filter is disposed in front of the gathering of the exhaust pipes.

4. The oil filter mounting arrangement for a four-cycle engine for use in a motorcycle according to claim 2, wherein the exhaust pipes are gathered below the engine while the oil filter is disposed in front of the gathering of the exhaust pipes.

5. The oil filter mounting arrangement for a four-cycle engine for use in a motorcycle according to claim 1, wherein the motorcycle bodywork including the engine sides is covered by a fairing.

6. The oil filter mounting arrangement for a four-cycle engine for use in a motorcycle according to claim 2, wherein the motorcycle bodywork including the engine sides is covered by a fairing.

7. The oil filter mounting arrangement for a four-cycle engine for use in a motorcycle according to claim 3, wherein the motorcycle bodywork including the engine sides is covered by a fairing.

8. The oil filter mounting arrangement for a four-cycle engine for use in a motorcycle according to claim 4, wherein the motorcycle bodywork including the engine sides is covered by a fairing.

9. The oil filter mounting arrangement for a four-cycle engine for use in a motorcycle according to any of claims 1 through 8, wherein the oil cooler is disposed on the same side as a water pump, with respect to the center line of the motorcycle.

* * * * *